United States Patent [19]

Mayo et al.

[11] Patent Number: 5,021,318

[45] Date of Patent: Jun. 4, 1991

[54] PROCESS FOR FORMING SECURE IMAGES

[75] Inventors: James D. Mayo; Stephen Drappel, both of Toronto; James M. Duff, Mississauga; Melvin D. Croucher, Oakville, all of Canada; John M. Lennon, Newark, Calif.

[73] Assignee: Xerox Corporation, Stamford, Conn.

[21] Appl. No.: 386,751

[22] Filed: Jul. 28, 1989

[51] Int. Cl.[5] ..... G03G 13/22

[52] U.S. Cl. ..... 430/124; 430/10; 430/99; 430/126; 156/235; 427/7; 428/916; 283/109

[58] Field of Search ..... 430/99, 124, 126, 10; 427/7; 428/916; 156/235; 283/109, 111

[56] References Cited

U.S. PATENT DOCUMENTS

| | | | |
|---|---|---|---|
| 2,221,776 | 9/1938 | Carlson . | |
| 2,297,691 | 4/1939 | Carlson . | |
| 2,357,809 | 11/1940 | Carlson . | |
| 3,130,064 | 4/1964 | Insalace . | |
| 3,275,436 | 7/1962 | Mayer . | |
| 3,549,447 | 12/1970 | Bresnick | 430/99 X |
| 3,716,360 | 2/1973 | Fukushima et al. | 430/124 X |
| 4,064,285 | 12/1977 | Mammino | 427/24 |
| 4,066,802 | 1/1978 | Clemens | 427/24 |
| 4,234,644 | 11/1980 | Blake et al. | 430/124 X |
| 4,287,285 | 9/1981 | Mosehauer | 430/126 X |
| 4,560,426 | 12/1985 | Moraw et al. | 156/235 X |
| 4,762,764 | 8/1988 | Ng et al. | 430/115 |
| 4,812,383 | 3/1989 | Foote | 430/126 |
| 4,863,543 | 9/1989 | Shiozawa et al. | 430/126 X |

FOREIGN PATENT DOCUMENTS

| | | | |
|---|---|---|---|
| 2933436 | 1/1981 | Fed. Rep. of Germany | 428/916 |

OTHER PUBLICATIONS

"Microfilm Process Embeds Photos Directly Into Security Documents", Lawrence Surtees, Toronto Sun, Sep. 21, 1984.

*Primary Examiner*—Roland Martin
*Attorney, Agent, or Firm*—Judith L. Byorick

[57] ABSTRACT

Disclosed is a process for forming secure images which comprises electrostatically charging an imaging member; imagewise exposing the charged member, thereby forming a latent image on the member; developing the latent image with a liquid developer comprising a liquid medium, a charge control additive, and toner particles comprising a colorant and a polymeric material; allowing the developed image to dry on the imaging member; contacting the portion of the imaging member with the dry developed image with a substantially transparent sheet having an adhesive material on the surface thereof in contact with the imaging member, thereby transferring the developed image from the imaging member to the substantially transparent sheet; contacting the adhesive surface of the substantially transparent sheet with the developed image with a paper sheet having a polymeric coating on the surface that is in contact with the substantially transparent sheet; and applying heat and pressure to the substantially transparent sheet and the paper sheet at a temperature and pressure sufficient to affix the image permanently to the paper. The resulting document is a paper sheet covered with the transparent sheet, with the developer material that forms the image being situated between the paper sheet and the transparent sheet. The disclosed process is generally useful for applications such as passport photographs, identification badges, banknote paper, and the like.

23 Claims, 2 Drawing Sheets

PROCESS FOR FORMING SECURE IMAGES

BACKGROUND OF THE INVENTION

The present invention is directed to a process for forming images, and more specifically, a process for forming secure images. Secure images are generally useful for applications such as passport photographs, identification badges, banknote paper, and the like. A secure image is formed by generating an image and transferring it to paper so that the image cannot be removed by mechanical or chemical means. Such an image is resistant to tampering and also prevents removal of the image and substitution of another image in its place, since any attempt at removal of the original image damages the paper. In one embodiment, the present invention is directed to a process for forming secure images which comprises electrostatically charging an imaging member; imagewise exposing the charged member, thereby forming a latent image on the member; developing the latent image with a liquid developer comprising a liquid medium, a charge control additive, and toner particles comprising a colorant and a polymeric material; allowing the developed image to dry on the imaging member; contacting the portion of the imaging member with the dry developed image with a substantially transparent sheet having an adhesive material on the surface thereof in contact with the imaging member, thereby transferring the developed image from the imaging member to the substantially transparent sheet; contacting the adhesive surface of the substantially transparent sheet with the developed image with a paper sheet having a polymeric coating on the surface that is in contact with the substantially transparent sheet; and applying heat and pressure to the substantially transparent sheet and the paper sheet at a temperature and pressure sufficient to affix the image permanently to the paper. The resulting document is a paper sheet covered with the transparent sheet, with the developer material that forms the image being situated between the paper sheet and the transparent sheet. The image is "secure" in that the transparent sheet bearing the image cannot be removed from the paper without irreparably damaging the paper.

Processes for transferring a developed image by applying adhesive material to the receiver sheet are known. For example, U.S. Pat. No. 2,297,691 discloses a process for transferring an image generated by electrophotographic means and developed with a dry powder developer to a receiver sheet to the surface of which has been applied an adhesive material such as water, other liquids, wax, paraffin, or other soft or sticky substances. In addition, U.S. Pat. No. 3,130,064 discloses a process for permanently affixing developed electrophotographic images to a support material such as a record card which entails treating the record card or other image support material with a coating of a thermoplastic organic resin compatible with the toner material, followed by application of heat or radiant energy. U.S. Pat. Nos. 2,221,776 and 2,357,809 also disclose transfer of an electrophotographic image to an adhesive substrate.

Additionally, U.S. Pat. No. 3,275,436 discloses a process for forming image reproductions wherein an adhesively tacky support base surface bearing a resist image is placed in contact against a second support base containing a releasable uniform surface film separable selectively by area subjected to adhesive attraction. The two support bases are then separated from each other, and the film from the second support base is released to the first support base in the surface areas devoid of the resist image.

Further, U.S. Pat. No. 4,064,285 discloses a process in which a toner image pattern is formed on a transfer member which is overcoated with a polymeric material. The polymeric material assists in the permanent adherence of the toner image to cloth or other substrate materials under heat and pressure. U.S. Pat. No. 4,066,802 discloses a process in which a toner image pattern is formed on a transfer member which has been overcoated with an abhesive material. A polymeric sheet is interposed between the toner image and a cloth or other image receiving medium. The polymeric sheet assists in the permanent adherence of the toner imaging pattern to the cloth material or other medium when the composite is subjected to heat and pressure.

In addition, U.S. Pat. No. 4,812,383, the disclosure of which is totally incorporated herein by reference, discloses a process for forming permanent electrophotographic images that comprises generating, in an electrophotographic imaging apparatus, an electrostatic latent image; developing the image with a liquid developer comprising a colorant, a solvent, and a polymeric material having adhesive properties when wetted with the solvent; transferring the image to a substrate having a coating comprising a polymeric material having adhesive properties when wetted with the liquid developer solvent; and permitting the image to dry on the substrate. The polymeric coating on the substrate preferably is of the same composition as the polymeric material in the developer, and may be a vinyl toluene acrylic terpolymer such as Pliolite ®OMS.

Although the prior art processes are believed to be suitable for their intended purposes, a need remains for processes for forming secure images. A need continues to exist for processes wherein a secure image is formed and transferred to paper and cannot be removed without damaging the paper. In addition, a need exists for processes for forming secure images that are resistant to tampering. There is also a need for processes for forming secure images suitable for applications such as passport photographs, identification badges, and banknote paper.

SUMMARY OF THE INVENTION

It is an object of the present invention to provide a process for forming secure images.

It is another object of the present invention to provide a process wherein a secure image is formed and transferred to paper and cannot be removed without damaging the paper.

It is still another object of the present invention to provide a process for forming secure images that are resistant to tampering.

It is yet another object of the present invention to provide a process for forming secure images suitable for applications such as passport photographs, identification badges, and banknote paper.

These and other objects of the present invention are achieved by providing a process for forming secure images which comprises electrostatically charging an imaging member; imagewise exposing the charged member, thereby forming a latent image on the member; developing the latent image with a liquid developer comprising a liquid medium, a charge control additive, and toner particles comprising a colorant and a polymeric material; allowing the developed image to dry on the imaging member; contacting the portion of the imaging member with the dry developed image with a substantially transparent sheet having an adhesive material on the surface thereof in contact with the imaging member, thereby transferring the developed image from the imaging member to the substantially transparent sheet; contacting the adhesive surface of the substantially transparent sheet with the developed image with a paper sheet having a polymeric coating on the surface that is in contact with the substantially transparent sheet; and applying heat and pressure to the substantially transparent sheet and the paper sheet at a temperature and pressure sufficient to affix the image permanently to the paper.

DETAILED DESCRIPTION OF THE INVENTION

Figure 1B:
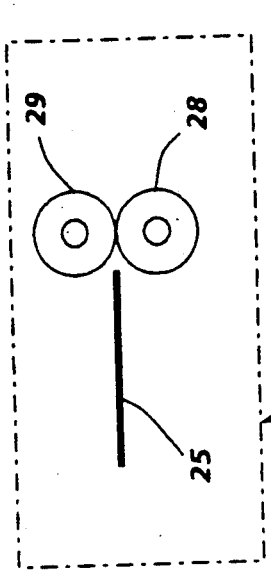
FIGS. 1A and 1B illustrate schematically the process of the present invention.
Figure 1A:
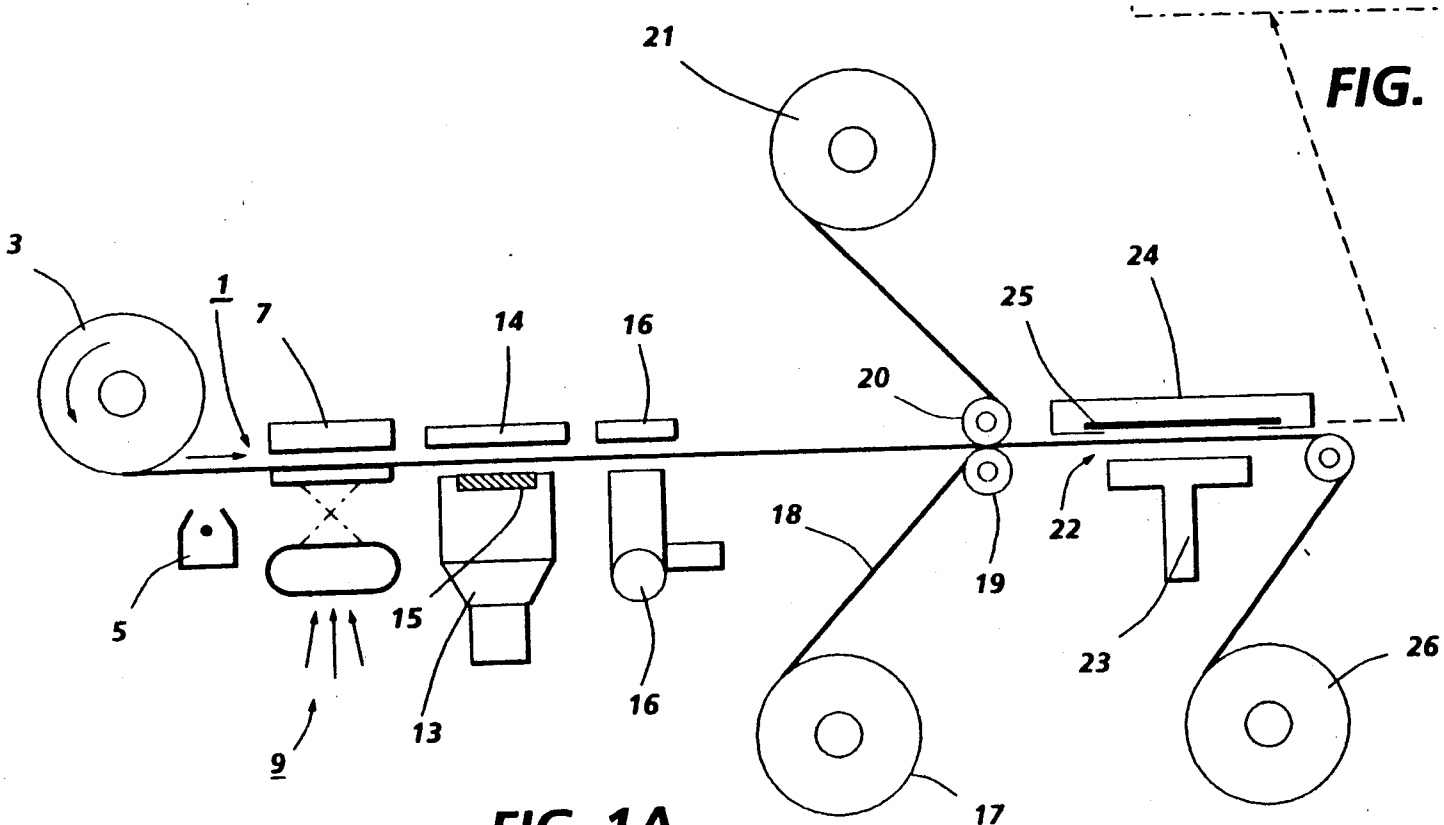

In FIGS. 1A and 1B an apparatus for implementing the process of the present invention is illustrated schematically. As shown in FIG. 1A, imaging member 1, which in this embodiment is a migration imaging member comprising a conductive substrate, a softenable polymer layer on the substrate, and a fracturable layer of closely packed photosensitive particles embedded near the surface of the softenable layer spaced from the substrate, is unrolled from supply roll 3 in the direction of the arrows and charged with a charging means 5, which may be a corotron or any other suitable charging device. Subsequent to charging, imaging member 1 is advanced to exposure station 7, wherein a light image passes through optical system 9, thereby discharging portions of the charged imaging member in imagewise fashion. Exposure may be either of an existing document, such as a photograph, or of a live subject. Subsequently, imaging member 1 is advanced to toning station 13, where the latent image on imaging member 1 is developed with a liquid developer. Development can be by any suitable means; in one embodiment, a clamp or pressure pad 14 is applied to the surface of imaging member 1 that does not bear the latent image, thereby securing the surface of imaging member 1 bearing the latent image inside of a liquid developer bath 15, wherein circulating liquid developer develops the image. After development, imaging member 1 bearing the developed image is advanced to drying station 16, where any liquid developer remaining in background areas on imaging member 1 is removed by suitable means, such as blown air, heated blown air, and the like. Imaging member 1 then passes transparent adhesive tape dispenser 17, and a transparent adhesive tape 18 is applied to imaging member 1 at a nip situated between pressure roller 19, which contacts adhesive tape 18, and pressure roller 20, which contacts imaging member 1. The nip between pressure rollers 19 and 20 provides sufficient pressure to cause adhesive tape 18 to adhere to imaging member 1 and to effect transfer of the developed image from imaging member 1 to transparent adhesive tape 18. Imaging member 1 is subsequently separated from adhesive tape 18 at pressure roller 20, and imaging member 1 is then rolled onto imaging member takeup roll 21. Subsequent to separation, a minimal or residual image remains on imaging member 1, which provides an archival record of images formed on the imaging member. Adhesive tape 18, subsequent to separation, advances to transfer station 22, where the imaged portion of the tape is transferred directly to coated paper 25 by means of punch 23 and die 24, which perforate the imaged portion of adhesive tape 18 and cause the perforated portion to adhere to coated paper 25. The remaining portion of adhesive tape 18 is then wound onto adhesive tape takeup roller 26. Coated paper 25, to which now adheres the perforated portion of the tape bearing the developed image, is then removed from the apparatus and, as shown in FIG. 1B, is fed through fusing apparatus 27, which comprises heated pinch rollers 28 and 29, where coated paper 25, upon which is the transferred image, is subjected to heat and pressure, thereby causing the image to adhere permanently to the paper.

Any suitable imaging member may be employed with the process of the present invention, such as a layered organic imaging member in the form of a drum or a flexible belt, or an inorganic photoreceptor of materials such as selenium, selenium/arsenic alloys, selenium/tellurium alloys, ternary alloys of selenium, arsenic, and tellurium, selenium, arsenic and bismuth, selenium arsenic, and antimony, and the like. The inorganic materials may also be doped with materials such as halogens, including chlorine, in amounts such as from about 10 to about 500 parts per million. Illustrative examples of suitable photoreceptors are set forth in U.S. Pat. No. 4,265,990, the disclosure of which is totally incorporated herein by reference. Particularly preferred are migration imaging members, which are capable of generating images of excellent resolution. Migration imaging members typically comprise a conductive substrate layer, a layer of softenable polymeric material, and a fracturable layer of photosensitive particles on or near the surface of the softenable polymeric layer that is not in contact with the conductive layer. Imagewise exposure of a charged migration imaging member followed by subjecting the softenable layer to softening by methods such as heating, solvent exposure, or the like causes the photosensitive particles to migrate selectively through the softenable layer in imagewise fashion. Examples of typical substrates are metallized 75 to 125 micron thick metallized polyester, such as aluminized Mylar®, semitransparent aluminum, copper, brass, nickel, zinc, chromium, stainless steel, conductive plastics and rubbers, aluminum, steel, cadmium, silver, gold, indium, tin, metal oxides, including tin oxide and indium tin oxide, titanized Mylar®, and the like. Examples of suitable polymers include styrene-acrylic copolymers, such as styrene-hexylmethacrylate or styrene-ethylacrylate-acrylic acid copolymers, polystyrenes including polyalphamethyl styrene, styrene-olefin copolymers, styrene-vinyltolunene copolymers, polyesters, polyurethanes, polycarbonates, polyterpenes, silicone elastomers, copolymers thereof, mixture thereof, and the like. Other suitable polymeric materials are disclosed, for example, in U.S. Pat. Nos. 3,975,195; 3,909,262; 4,536,457; 4,536,458; 4,013,462; 4,081,273 and 4,135,926, incorporated herein by reference. Examples of suitable photosensitive materials include selenium, selenium alloys, phthalocyanines, and the like. The migration imaging member can be prepared by solution coating the conductive substrate with the softenable polymeric material, followed by heating the polymeric material to soften it and then thermally evaporating the photosensitive material onto the polymeric material in a vacuum chamber. Optionally, an abrasion resistant polymer overcoat can be solution coated onto the structure. Migration imaging members are well known, and are described in detail in U.S. Pat. Nos. 3,975,195, 3,909,262, 4,536,457, 4,536,458, 4,013,462, 4,081,273, 4,135,926, and P.S. Vincett, G. J. Kovacs, M. C. Tam, A. L. Pundsack, and P. H. Soden, *Migration Imaging Mechanisms, Exploitation, and Future Prospects of Unique Photographic Technologies*, XDM and AMEN, Journal of Imaging Science 30 (4) Jul/Aug, pp. 183–191 (1986), the disclosures of each of which are totally incorporated herein by reference.

Figure 2:
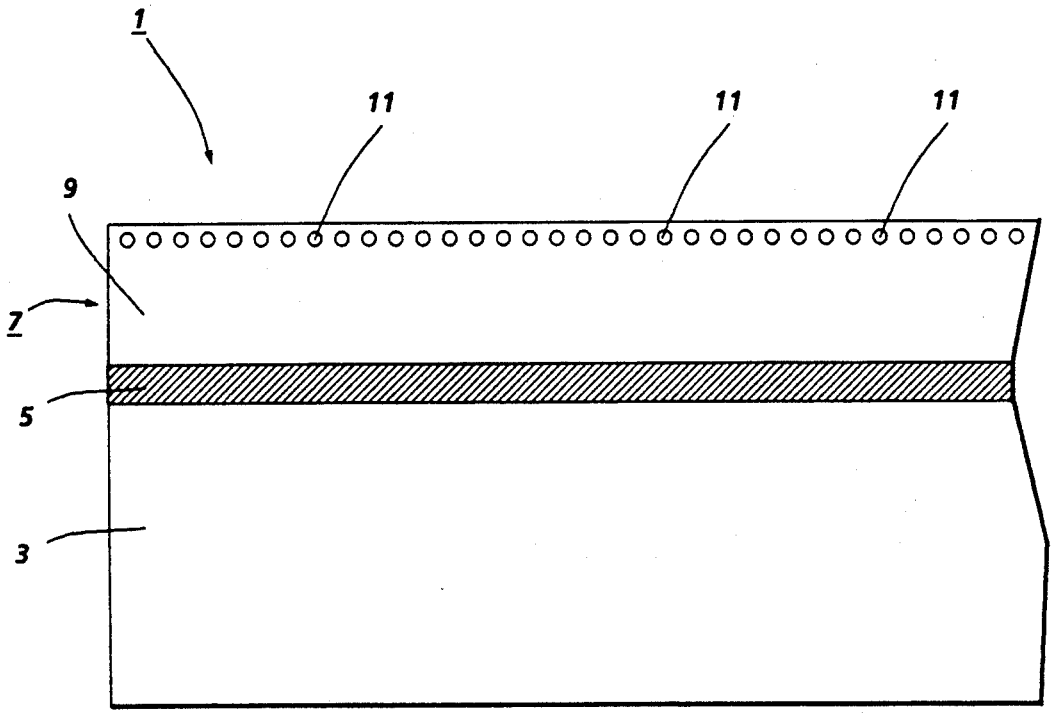
FIG. 2 illustrates schematically an example of an imaging member suitable for the process of the present invention.

A migration imaging member preferred for one embodiment of the process of the present invention is illustrated in FIG. 2. As shown in FIG. 2, migration imaging member 1 comprises a first layer 3 of polyester such as Melinex 447, commercially available from ICI Americas, Inc., of a thickness of about 5 mils. This layer functions as a substrate to impart to the imaging member the desired degree of stiffness. A second layer 5 is conductive and comprises semi-transparent aluminum with about 40 percent transmission of light, of a thickness of from about 75 to about 100 Angstroms. A third layer 7 comprises a softenable polymer 9 such as styrene-ethylacrylate-acrylic acid copolymer wherein styrene is present in an amount of about 75 percent by weight, ethyl acrylate is present in an amount of about 24 percent by weight, and acrylic acid is present in an amount of about 1 percent by weight; this material is doped with a material such as N,N'-diphenyl-N,N'-bis(3''-methylphenyl)-(1,1'-biphenyl)4,4'-diamine or 4-diethylaminobenzaldehyde-1,1-diphenylhydrazone, generally in an amount of from about 16 to about 24 percent by weight. Other examples of suitable charge transport materials are disclosed, for example, in U.S. Pat. Nos. 4,536,457; 4,536,458; 4,306,008; 4,304,829; 4,233,384; 4,115,116; 4,299,897; 4,081,274; 4,315,982; 4,278,746; 3,837,851; 4,245,021; 4,150,987; 4,385,106; 4,338,388 and 4,387,147; 4,256,821; 4,297,426; 3,972,717; 3,895,944; 3,820,989; 4,474,865 and 3,870,516; and German Patents 1,058,836; 1,060,260 and 1,120,875, the disclosures of each of which are totally incorporated herein by reference. Situated near the surface of layer 7 that is not in contact with layer 5 is a monolayer of selenium spheres 11 of a diameter of about 0.3 micron. Layer 7 generally is of a thickness of about 2 microns.

Subsequent to formation of the latent image, the image is developed with a liquid developer. Suitable liquid developers provide reproducible, high density, high resolution images, develop and adhere to the imaging member during development, transfer from the imaging member to an adhesive tape when dried, and fuse securely into the selected paper upon application of heat and pressure. Suitable liquid developers generally comprises a liquid medium, toner particles comprising a colorant, a polymeric material, and a charge control agent. One preferred liquid developer comprises a liquid medium, toner particles comprising pigment particles and a polymeric material, which preferably is adsorbed onto the pigment particle surfaces, and a charge control agent. Other suitable liquid developers include those comprising a liquid medium, a charge control agent, and toner particles which comprises a dye and a polymeric core to which steric stabilizing copolymers have been attached. Further information regarding liquid developers containing sterically stabilized toner particles is disclosed in U.S. Pat. Nos. 4,476,210 and 4,830,945, the disclosures of each of which are totally incorporated herein by reference.

The liquid medium functions as a neutral medium in which the other components of the developer are uniformly dispersed. Materials suitable for the liquid medium include high purity aliphatic hydrocarbons with, for example, from about 7 to about 25 carbon atoms and preferably with a viscosity of less than 2 centipoise, such as Norpar ®12, Norpar ®13, and Norpar ®15, available from Exxon Corporation, isoparaffinic hydrocarbons such as Isopar ®G,H,K,L,M, available from Exxon Corporation, Amsco ®460 Solvent, Amsco-®OMS, available from American Mineral Spirits Company, Soltrol ®, available from Phillips Petroleum Company, Pagasol ®, available from Mobil Oil Corporation, Shellsol ®, available from Shell Oil Company, and the like. Generally, the liquid medium is present in a large amount in the developer composition, and constitutes that percentage by weight of the developer not accounted for by the other components. The liquid medium is usually present in an effective amount, generally from about 97.5 to about 99.5 percent by weight, although the amount can vary from this range.

Examples of suitable colorant materials include pigments such as Raven ®5750 and Raven ®3500, available from Columbian Chemicals Company, Mogul L, available from Cabot Corporation, Regal ®330 carbon black, available from Cabot Corporation, Vulcan, available from Cabot Corporation, Sudan Blue OS, available from BASF, Hostaperm Pink E, available from American Hoechst Corporation, Permanent Yellow FGL, available from American Hoechst Corporation, Lithol Rubine DCC-2734, available from Dominion Color Company, and the like. Generally, any pigment material is suitable provided that it combines effectively with the polymeric resin material and that it is capable of sustaining an electrostatic charge of the desired polarity.

Examples of suitable polymeric materials include polyethylene and polypropylene and their copolymers, including ethylene-vinyl acetate copolymers such as the Elvax ®I resins available from E.I. DuPont de Nemours & Company, copolymers of ethylene and an $\alpha$, $\beta$-ethylenically unsaturated acid selected from acrylic or methacrylic acid, where the acid moiety is present in an amount of from 0.1 to 20 percent by weight, such as the Elvax ®II resins available from E.I. DuPont de Nemours & Company, including Elvax ®410 (an ethylene/vinyl acetate copolymer), chlorinated olefins such as chlorinated polypropylene, including CP-343-1, available from Eastman Kodak Company, poly-$\alpha$-olefins such as polyoctadecene and polyhexadence, styrene/ethylene-butylene/styrene block copolymers such as Kraton ®1701, available from Shell, vinyl toluene acrylic copolymers, including Neocryl ®S1004 and Neocryl ®EX519 available from Polyvinyl Chemical Industries and vinyl toluene-acrylate copolymers such as Pliolite ®OMS available from Goodyear Tire and Rubber Company, polybutenes, such as Parapol ®, available from Exxon Corporation, polyisobutylene rubbers, such as Vistanex ®MML, available from Exxon Corporation, mixtures thereof, and the like.

Toner particles preferred for the process of the present invention generally comprise a pigment and a resin, wherein the resin is present in an effective amount, generally from about 25 to about 75 percent by weight, preferably from about 33 to about 67 percent by weight, and more preferably from about 40 to about 60 percent by weight, and the pigment is present in an effective amount, generally from about 25 to about 75 percent by weight, preferably from about 33 to about 67 percent by weight, and more preferably from about 40 to about 60 percent by weight.

The preferred toner particles generally have an average particle diameter of from about 0.1 micron to about 5 microns, preferably from about 0.3 to about 2 microns, and more preferably from about 0.45 to about 0.55 micron, as determined by a Brookhaven BI-90 particle size analyzer, which determines average volume particle diameter. The toner particles are present in the developer in an effective amount, generally from about 0.4 to about 2 percent by weight, and preferably from about 0.8 to about 2 percent by weight of the developer composition.

The liquid developers suitable for the process of the present invention generally also contain a charge control additive for the purpose of imparting a positive or negative charge to the toner particles. Examples of charge control additives suitable for the present invention include iron naphthenate and zirconium octoate, which are available from Nuodex, lecithin, which is available from Fisher Scientific, basic barium petronate, available from Witco Chemical Company, polyisbutylene succinimide, available from Chevron Chemical Company as OLOA 1200, and the like. The charge control additive can be added to the liquid developer subsequent to formation of the toner particles in the liquid medium, or can be present with the other developer ingredients during preparation of the developer composition. The charge director is present in an effective amount, generally, for example, from about 2.5 to about 15 percent by weight of the solids content of the developer composition without the charge control additive, and preferably from about 5 to about 10 percent by weight of the solids content of the developer composition without the charge control additive. For the present invention, the amount present is generally expressed as a percentage by weight of the solids content of the developer composition without the charge control agent present. For example, in a developer comprising 95 grams of liquid medium and 5 grams of toner particles, the solid portion of the charge control agent added would be from about 0.125 grams to about 0.75 gram, and preferably from about 0.25 to about 0.5 gram. In general, the solid portion of the charge control agent is present in an amount of from about 25 to about 150 milligrams per 1 gram of toner particles, and preferably from about 50 to about 100 milligrams per 1 gram of toner particles.

Liquid developers employed for the process of the present invention preferably have a conductivity of from about 25 to about 75 picomhos, more preferably from about 40 to about 60 picomhos, and most preferably about 50 picomhos. These conductivity values are based on measurement techniques employing a cell comprising two concentric cylindrical electrodes held 1 millimeter apart. The cell is placed in a solution of the liquid developer and a 5 volt, 5 Hertz square wave is applied across the 1 millimeter gap in the cell. The total current passing through the cell is then integrated to obtain a measure of AC conductivity in picomhos per centimeter.

In addition, liquid developers suitable for the process of the present invention generally have a triboelectric charge on the toner particles of from about ±100 to about ±1,000 microcoulombs per gram, preferably from about ±300 to about ±600 microcoulombs per gram, and more preferably from about ±450 to about ±550 microcoulombs per gram. Triboelectric charge or charge to mass ratio (Q/m) can be measured with a cell comprising two stainless steel plates held vertically 1 centimeter apart in an enclosed polyethylene casing. The gap is filled with the liquid developer and a constant voltage of 800 volts is applied across the cell for 1 minute with, for example, a Fluke 415B high voltage power supply. The current output across the cell is detected with, for example, a Keithley Model 616 electrometer, and is fed into an integrator for signal processing. A plot of current versus time as well as integrated current versus time is made on a two-pen chart recorder, and the area under the integrated current versus time curve is then calculated to yield charge (Q). The solids in the developer plateout onto the electrode charged oppositely to the particles, typically within 5 to 10 seconds. After 1 minute, the voltage is stopped, and the plated electrode is quickly removed, oven-dried and weighed to determine the mass (M) of the developer particles. Dividing charge (Q) by mass (M) yields triboelectric charge. Further details regarding measurement of triboelectric charge are disclosed, for example, in V. Novotny and M. L. Hair, *Simple Electrical Plateout Method for Measuring Charge/Mass of Nonaqueous Suspensions*, Journal of Colloid and Interface Science, Vol. 71, No. 2, pages 273 to 282 (1979), the disclosure of which is totally incorporated herein by reference. Generally, the charge on the toner particles in the liquid developer is determined by the charge control agent, although the resin and pigment materials can also affect charge. The liquid developer can be charged to either polarity, provided that its polarity is opposite to that of the latent image on the selected imaging member when positive images are desired and the same as that of the latent image when negative images are to be developed in refersal mode development. For example, when the imaging member employed is as illustrated in FIG. 2, a negatively charged developer is employed to form a positive image.

The liquid developers selected for the process of the present invention generally are capable of providing reproducible, high density, high resolution images of about at least 15 to 20 line pairs per millimeter, are capable of developing on and adhering to the selected imaging member, are capable of transferring from the imaging member to an adhesive sheet or tape when the developed image has dried, and fuse securely into the coated paper upon application of heat and pressure.

One particularly preferred liquid developer for the process of the present invention comprises an isoparaffinic hydrocarbon (available as Isopar ®G from Exxon Chemical Company), a carbon black pigment such as Raven ®3500 or Raven ®5750 (available from Columbian Chemicals), a vinyl toluene-acrylate copolymer such as Pliolite ®OMS (available from Goodyear Tire and Rubber Company), and a charge control agent. One preferred charge control agent is polyisobutylene succinimide (available as OLOA 1200 from Chevron Chemical Company). In one preferred embodiment, the liquid developer comprises from about 0.2 to about 1 percent by weight of the pigment, from about 0.2 to about 1.0 percent by weight of the polymer, from about 97.5 to about 99.5 percent by weight of the liquid medium, and the charge control agent in an amount of from about 2.5 to about 15 percent by weight of the solids content of the developer.

The liquid developers generally can be prepared by mixing the liquid medium, the resin, and the pigment components in a bottle containing grinding media such as stainless steel shot, diluting the components with the liquid medium to a concentration of about 25 percent solids (w/w), and dispersing the mixture by ball milling at room temperature for about 18 hours, resulting in formation of toner particles comprising the pigment and resin. Subsequently, the mixture is diluted to the desired solids content of the liquid developer, generally from about 0.5 to about 5 percent by weight solids. The charge control agent can be added subsequent to toner particle formation to form the final liquid developer composition; alternatively, and particularly when the charge control agent is one such as polyisobutylene succinimide and also acts as a dispersant for the other developer ingredients, the charge control agent can be added at the beginning of the preparation process with the other ingredients. Another suitable process for preparing the liquid developers comprises adding the resin and pigment particles in the appropriate amounts to the liquid medium selected for the liquid developer. Generally, the combined amounts of the resin and pigment comprise approximately 10 to 30 percent by weight of the mixture, and the liquid medium comprises about 70 to 90 percent by weight of the mixture. The resin is added to the liquid medium at room temperature in an attritor such as a Union Process Model 01 Attritor, and the mixture is then stirred as it is heated to about 120° C. When the resin has dissolved in the liquid medium, the pigment particles are added to the 120° C. mixture, and the resulting mixture is stirred for about 1 hour in the attritor. Subsequently, the mixture is cooled to room temperature over a period of about 2 hours as it is stirred, and stirring is continued for about 1 additional hour after cooling, causing the polymer to precipitate from solution to form composite particles of resin and pigment and resulting in a relatively concentrated dispersion containing the toner particles present in an amount of about 10 to 30 percent by weight in the liquid medium. The particles formed are generally of from about 0.5 to about 5 microns in average diameter. When present, the charge control agent can either be added after particle formation to form the final developer composition, or it can be added at the beginning of the developer preparation process with the other developer ingredients.

Subsequent to development and drying of the developed image on the imaging member, the developed image is transferred to a substantially transparent sheet or tape with an adhesive material on the surface that contacts the image. Any adhesive material is suitable for the present invention provided that it is substantially transparent and has fairly low tack so as not to destroy the imaging member upon separation. By substantially transparent is meant sufficient transparency to enable the developed and transferred image to be viewed through the tape to the extent necessary or desirable for the intended use of the process of the present invention; greater degrees of transparency are preferred. Examples of suitable tapes include Scotch® Magic Transparent Tape, Magic Mending Tape #810, available from 3M, Adhesive Tape #600, available from 3M, Highland Tape #371, available from 3M, Adhesive Tape #1100, available from Cellotape Inc., Invisible Mending Tape, available from Cellotape Inc., Tesa 4104, available from BDF Tesa Corporation, and the like.

The transparent adhesive sheet or tape bearing the developed image is then applied to a paper substrate. To enhance the degree of fix of the image to the paper, the paper is coated with a thin layer of a polymeric material prior to contacting it with the adhesive sheet or tape bearing the image. Generally the polymeric material is soluble in a solvent that does not degrade paper, such as aliphatic hydrocarbons such as pentane, hexane, octane, the Isopars®, and the like, acetone, ethyl acetate, mixtures of acetone and ethyl acetate, ethers, tetrahydrofuran, or any other suitable solvent, preferably has a glass transition point ($T_g$) of less than about 100° C., and exhibits acceptable film-forming characteristics. When the paper to be coated contains an encapsulated security dye, the solvent is selected so that it does not dissolve the security dye in the paper; examples of such solvent include aliphatic hydrocarbons, such as hexane. Suitable polymeric materials for coating the paper include vinyl toluene acrylic copolymers such as Neocryl® S1004, Neocryl® EX 519 and vinyl toluene/acrylate copolymers such as Pliolite® OMS, polybutene rubbers such as Parapol®, polyisobutylene rubbers such as Vistanex® MML, vinyl halide/vinyl acetate copolymers, such as VYHH, a vinyl chloride/vinyl acetate copolymer available from Union Carbide Corporation, mixtures thereof, and the like. The polymeric material selected for the paper coating may be the same as the polymeric material contained in the liquid developer, or it may be a different polymer from that contained in the liquid developer. The polymeric material is coated on the paper in an effective amount, generally in a thickness of from about 0.5 to about 10 microns, and preferably from about 2 to about 5 microns.

The coating composition may be prepared by first preparing a solvent, such as hexane or a mixture of ethyl acetate and acetone, adding to the solvent the polymeric material, such as Pliolite® OMS, and stirring the solution at low speed until the polymeric material is dissolved in the solvent. An additional amount of the solvent is then added as the solution is stirred at low speed until a homogeneous mixture is achieved. The mixture is filtered to remove undissolved solids, and is then ready for application to the paper.

For applying the coating composition to the paper, any suitable method may be employed. For example, the coating composition may be dissolved in one or more solvents, such as in hexane or a mixture of about 50 percent acetone and about 50 percent ethyl acetate; in an acetone/ethyl acetate solvent system, a level of about 20 percent by weight of the solid components of the coating composition in the solution has been observed to work well. A mist of the solvent-coating composition mixture may be sprayed onto the substrate surface, after which the solvent is permitted to evaporate. Another suitable method is application of the coating solution by means of a doctor blade, wherein the solution is poured onto a flexible blade, and a uniform layer of the coating solution is applied to a passing substrate, after which the solvent is permitted to evaporate. A third suitable method is application of the coating by means of a Meyer rod, wherein a solution of the coating composition is poured onto a rod having wire wrapped tightly around it in a spiral configuration, such that the wire contacts the substrate at uniform intervals, and the coating solution is metered onto the substrate in the areas where the wire does not contact the substrate.

The coating composition may be applied to the substrate in the thickness desired to achieve the objects of the present invention. For example, the coating may be present on the substrate in thickness of from about 0.5 to about 10 microns.

The paper employed generally may be any fairly porous, non-smooth paper, such as Xerox® 4024 paper, identification badge or passport document paper, Auto Mimeo (90 g/m$^2$), available from Domtar Corporation, Rolland Antique Linen (Laid Finish/Bright White) (90 g/m$^2$), available from Rolland Corporation, Rolland Parchment (White) (75 g/m$^2$), available from Rolland Corporation, and the like. Smooth coated or filled papers such as Litho Stock or other smooth or silica coated papers generally are not suitable because the dried toner particles comprising the developed image do not penetrate the paper.

Subsequent to application of the transparent adhesive sheet or tape bearing the developed image to the coated surface of the paper, the paper and transparent adhesive sheet are passed together through a heat and pressure fusing device to fix the image permanently to the paper, thereby forming a secure image. Fusing conditions such as pressure, temperature, rate at which the paper and transparent sheet pass through the fuser, and the like are determined by the materials selected for the liquid developer and for the paper coating. Fusing occurs at an effective pressure for the selected materials, and generally is at from about 50 to about 200 pounds per square inch, preferably at from about 100 to about 150 pounds per square inch. Fusing is at an effective temperature for the selected materials, and generally is at from about 80° C. to about 200° C., preferably from about 100° C. to about 150° C. Fusing is at an effective rate for the selected materials, and generally is at from about 0.2 to about 2 inches per second, preferably from about 0.75 to about 1.25 inches per second. An example of a suitable fusing apparatus is the fusing subsystem employed in the Xerox® 1075 copier. Fusing results in the developed image penetrating the paper fibers so that subsequently the transparent sheet or tape cannot be removed without destroying the image.

Optionally, a taggant material can be incorporated into the liquid developer as an additional security measure. When a taggant is present in the developer, any subsequent removal or attempted removal of the image from the paper also removes some or all of the taggant material. Thus, scanning a document wherein the image was developed with a tagged developer indicates that the original image is still in place and undisturbed. Examples of suitable taggant materials include fluorescent or phosphorescent pigments, such as Radiant JST-300-320 Chartreuse, available from Hercules Inc., Radiant JST-318 Magenta, available from Hercules Inc., Radiant R-103-G-119 Blue, available from Hercules Inc., and the like, and infrared absorbing pigments, such as dihydroxy metal phthalocyanines (silicon, tin, germanium) as disclosed in U.S. Pat. No. 4,557,989, the disclosure of which is totally incorporated herein by reference. Generally, the taggant materials are present in the liquid developer in an amount of from about 1 to about 10 percent by weight. One method of adding the taggant material to the liquid developer entails preparing the developer concentrate as described herein, subsequently adding the taggant material to the concentrate and mixing the concentrate for about 30 minutes, and then diluting the developer to the desired solids concentration. Another method of adding the taggant material to the developer entails adding the desired amount of the taggant material to the final developer composition and mixing the ingredients to form a uniform dispersion.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A liquid developer composition was prepared by charging a Union Process 1-S attritor (capacity 1 U.S. gallon), available from Union Process Company, Akron, OH, with a solution of 300 grams of Pliolite® OMS (vinyl toluene acrylate copolymer available from Goodyear Tire and Rubber Company) in 1300 grams of Isopar® G (isoparaffinic hydrocarbon available from Exxon Chemical Americas), 120 grams of OLOA 1200 (polyisobutylene succinimide available from Chevron Chemical Company as a solution of 50 percent by weight of the polyisobutylene succinimide and 50 percent by weight of a paraffinic hydrocarbon liquid vehicle) (100 milligrams of solid portion of OLOA 1200 per 1 gram of pigment/resin particle materials), 680 additional grams of Isopar® G, and 300 grams of Raven 5250 (carbon black available from Columbian Chemical Company). Cooling water at a temperature of 50° F. was circulated in the attritor jacket at a flow rate of 0.3 gallon per minute and the mixture was milled in the attritor for 3 hours. This developer concentrate (25% w/w) was then diluted to a working concentration of 1% (w/w) by the addition of Isopar® G in the appropriate amount (2340 grams of Isopar® G for every 100 grams of developer concentrate). The toner particles in this developer exhibited a triboelectric charge of −500 microcoulombs per gram ±50 microcoulombs per gram.

EXAMPLE II

A liquid developer composition was prepared by charging a Union Process 1-S attritor (capacity 1 U.S. gallon), available from Union Process Company, Akron, OH, with a solution of 300 grams of Pliolite® OMS (vinyl toluene acrylate copolymer available from Goodyear Tire and Rubber Company) in 1300 grams of Isopar® G (isoparaffinic hydrocarbon available from Exxon Chemical Americas), 60 grams of OLOA 1200 (polyisobutylene succinimide available from Chevron Chemical Company as a solution of 50 percent by weight of the polyisobutylene succinimide and 50 percent by weight of a paraffinic hydrocarbon liquid vehicle) (50 milligrams of solid portion of OLOA 1200 per 1 gram of pigment/resin particle materials), 560 additional grams of Isopar® G, and 300 grams of Raven 5250 (carbon black available from Columbian Chemical Company). Cooling water at a temperature of 50° F. was circulated in the attritor jacket at a flow rate of 0.3 gallon per minute and the mixture was milled in the attritor for 3 hours. This developer concentrate (25% w/w) was then diluted to a working concentration of 1% (w/w) by the addition of Isopar® G in the appropriate amount. The toner particles in this developer exhibited a triboelectric charge of −400 microcoulombs per gram ±40 microcoulombs per gram.

EXAMPLE III

A liquid developer composition was prepared by heating a Union Process OS attritor (capacity 750 milliliters), available from Union Process Company, Akron, OH, to 120° C. and then charging it with 170 grams of Isopar® G (isoparaffinic hydrocarbon available from Exxon Chemical Americas), 20 grams of Elvax II 5720 resin (poly(ethylene-comethacrylic acid) copolymer available from DuPont de Nemours and Company), and 10 grams of Hostaperm Pink E (magenta pigment available from American Hoechst Corporation). The contents of the attritor were milled for 1 hour at 120° C., and the temperature was then lowered to 30° C. over a period of 2 hours (while stirring) and the milling continued for a fourth hour at 30° C. This developer concentrate (15% solids w/w) was then diluted to a working concentration of 1% solids (w/w) by the addition of Isopar® G in the appropriate amount. A negative charge was then imparted to the developer by the addition of polyisobutylene succinimide, available as OLOA 1200 from Chevron Chemical Company, as a 10% (w/w) solution in Isopar® G in a sufficient amount to result in a concentration of 100 milligrams of polyisobutylene succinimide per 1 gram of toner particles in the final developer. The toner particles in this developer exhibited a triboelectric charge of −500 microcoulombs per gram ±50 microcoulombs per gram.

EXAMPLE IV

A coating solution (20% w/w) was prepared by dissolving 20 grams of Pliolite® OMS (vinyl toluene acrylate copolymer available from Goodyear Tire and Rubber Company) in 80 grams of hexane (available from BDH Chemicals Limited), and then filtering the solution through a 45 micron sieve to remove any undissolved material.

EXAMPLE V

A coating solution (20% w/w) was prepared by dissolving 20 grams of Neocryl® S1004, available from Polyvinyl Chemical Industries, in 80 grams of hexane, available from BDH Chemicals Limited, and then filtering the solution through a 45 micron sieve to remove any undissolved material.

EXAMPLE VI

A coating solution (20% w/w) was prepared by dissolving 20 grams of Pliolite® OMS, available from Goodyear Tire and Rubber Company, in 80 grams of acetone, available from BDH Chemicals Limited, and then filtering the solution through a 45 micron sieve to remove any undissolved material.

EXAMPLE VII

A coating solution (20% w/w) was prepared by dissolving 20 grams of Pliolite® OMS, available from Goodyear Tire and Rubber Company, in 80 grams of Isopar® G, available from Exxon Chemical Americas, and then filtering the solution through a 45 micron sieve to remove any undissolved material.

EXAMPLE VIII

A coating solution (20% w/w) was prepared by dissolving 20 grams of a vinyl chloride/vinyl acetate copolymer wherein the vinyl chloride to vinyl acetate weight ratio composing the polymer was about 86 percent by weight vinyl chloride and about 14 percent vinyl acetate (VYHH, commercially available from Union Carbide Corporation), in 80 grams of acetone, available from BDH Chemicals Ltd., and then filtering the solution through a 45 micron sieve to remove any undissolved material.

EXAMPLE IX

The solution (20% w/w) of Example IV was coated onto a security paper available from Canadian Bank Note Company. This paper was non-smooth, possessed a distinctive background color pattern, and contained a series of randomly placed particles containing an encapsulated dye incorporated into the paper fibers; the encapsulated dye particles prevent tampering with the paper by rupturing if the paper is subjected to solvent treatment with various solvents such as acetone, tetrahydrofuran, toluene, and the like. The coating was applied with a laboratory drawdown coating device fitted with an aluminum coating bar having a coating gap of 2 mil and moving at approximately 1.25 inches per second, resulting in a dry coating approximately 2–5 microns thick.

EXAMPLE X

The solution (20% w/w) of Example IV was coated onto a security paper available from Canadian Bank Note Company. This paper was non-smooth, possessed a distinctive background color pattern, and contained a series of randomly placed particles containing an encapsulated dye incorporated into the paper fibers; the encapsulated dye particles prevent tampering with the paper by rupturing if the paper is subjected to solvent treatment with various solvents such as acetone, toluene, tetrahydrofuran, and the like. The coating was applied with a hand-held wire-wound metering rod (#12) available from Paul N. Gardner Company Inc. which was pulled across the paper at approximately 1 inch per second, resulting in a dry coating approximately 2–5 microns thick.

EXAMPLE XI

Images were prepared according to a process of the present invention as follows. A continuous roll of 70 millimeter wide film comprising a migration imaging member with a 5 mil Melinex 447 polyester film substrate layer, a 80 Angstrom conductive layer of semitransparent aluminum, and a 2 micron layer of a styrene-ethyl acrylate-acrylic acid terpolymer doped with about 20 percent by weight of N,N'-diphenyl-N,N'-bis(-3''-methylphenyl)-(1,1'-biphenyl)-4,4'-diamine and containing a monolayer of 0.3 micron selenium spheres situated 0.15 micron apart and 0.15 micron beneath the surface of the polymer layer not in contact with the semitransparent aluminum layer, was transported under a corotron wire, where a 70 millimeter square portion of the film was sensitized to light by charging. A photographic image was then exposed to the charged portion of the film, using a fluorescent light source and a series of collimators and focusing lenses, resulting in a positively charged latent image (positive) on the surface of the film. The exposed portion of film was then transported and clamped in a circulating bath of the liquid developer of Example I, and the developer allowed to flow over the surface of the film for 10 seconds. The wet developed image was then transported and clamped under a forced-air dryer for 25 seconds. Subsequently, the dried image was transported through a pressure nip, where it was placed in intimate contact with a roll of Scotch® Brand Magic transparent tape (available from 3M Company), resulting in the transfer of approximately 80 percent of the dried toner from the film to the tape. The imaged section of the tape was then physically transferred to the coated substrate described in Example IX by means of a punch and dye mechanism.

This imaging procedure was repeated using the liquid developers of Examples II and III.

EXAMPLE XII

The images prepared in Example XI were fused to the coated substrates by passing them through a heated pressure nip at a speed of 1 inch per second, a temperature of 115° C., and a pressure of 130 pounds per square inch. Subsequent to the fusing process, any attempt to remove the image by removing the 2 inch by 2 inch square of adhesive tape from the substrate resulted in either the destruction of the underlying paper fibers if separation was performed quickly (within less than 1 second), or in the image remaining on the paper surface if separation was performed more carefully and slowly (over a period of about 30 seconds). In both situations, the relative transparency of the images on the adhesive tape prevented the replacement of an image without that same area being visibly flawed, since either the damage to the underlying paper or the remains of the previous image were clearly visible through the transparent tape on which was contained the replacement image. In the situation where separation was performed quickly, the torn paper fibers provided a sharp contrast against the colored security printing on the document, which could be easily noticed through the new replacement image superimposed thereon. In the situation where separation was performed carefully and slowly, the underlying toner particles remaining on the paper from the removed image greatly distorted the new image superimposed thereon. All attempts to remove these toner particles mechanically from the paper surface by rubbing with an eraser and by scraping with a scalpel were either unsuccessful or resulted in the removal of the document's security printing. It is believed that any attempts to remove these toner particles with a solvent would result in the release of the encapsulated dyes on the paper surface. The images thus formed exhibited a high resolution of 15 to 20 line pairs per millimeter and an optical density in solid areas of from about 1.1 to about 1.2.

EXAMPLE XIII

Images were prepared according to the process of Example XI with the exception that the images were transferred to tape and the tape was then applied to a security paper available from Canadian Bank Note Company that had not been coated with a polymeric material. This paper was non-smooth, possessed a distinctive background color pattern, and contained a series of randomly placed particles containing an encapsulated dye incorporated into the paper fibers; the encapsulated dye particles prevent tampering with the paper by rupturing if the paper is subjected to solvent treatment with various solvents such as acetone, tetrahydrofuran, toluene, and the like. The images were fused to the uncoated substrates by passing them through a heated pressure nip at a speed of 1 inch per second, a temperature of 115° C., and a pressure of 130 pounds per square inch. Subsequent to the fusing process, the images were removed entirely from the paper by carefully peeling away the adhesive tape. It was then possible to substitute new images for the old ones without any evidence of tampering with the original documents by repeating the process of the present invention and placing a new piece of tape with a new image in the location of the original image. It is believed that in the absence of a polymeric coating on the paper, the toner particles exhibited a greater affinity for the adhesive tape than for the paper, and thus did not penetrate the paper fibers.

EXAMPLE XIV

Images were prepared according to the process of Example XI with the exception that the images were transferred to tape and the tape was then applied to a security paper available from Canadian Bank Note Company that had not been coated with a polymeric material. This paper was non-smooth, possessed a distinctive background color pattern, and contained a series of randomly placed particles containing an encapsulated dye incorporated into the paper fibers; the encapsulated dye particles prevent tampering with the paper by rupturing if the paper is subjected to solvent treatment with various solvents such as acetone, tetrahydrofuran, toluene, and the like. The images were fused to the uncoated substrates by passing them through a heated pressure nip at a speed of 1 inch per second, a temperature of 130° C., and a pressure of 500 pounds per square inch. Although both the paper and the adhesive tape were crushed under the applied pressure, the images were removed entirely from the paper subsequent to the fusing process by carefully peeling away the adhesive tape. It was then possible to substitute new images for the old ones without any evidence of tampering with the original documents by repeating the process of the present invention and placing a new piece of tape with a new image in the location of the original image. It is believed that in the absence of a polymeric coating on the paper, the toner particles exhibited a greater affinity for the adhesive tape than for the paper, and thus did not penetrate the paper fibers.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for forming secure images which comprises electrostatically charging an imaging member; imagewise exposing the charged member, thereby forming a latent image on the member; developing the latent image with a liquid developer comprising a liquid medium, a charge control additive, and toner particles comprising a colorant and a polymeric material; allowing the developed image to dry on the imaging member; contacting the portion of the imaging member with the dry developed image with a substantially transparent sheet having an adhesive material on the surface thereof in contact with the imaging member, thereby transferring the developed image from the imaging member to the substantially transparent sheet; contacting the adhesive surface of the substantially transparent sheet with the developed image with a paper sheet having a polymeric coating on the surface that is in contact with the substantially transparent sheet; and applying heat and pressure to the substantially transparent sheet and the paper sheet at a temperature and pressure sufficient to affix the image permanently to the paper.

2. A process according to claim 1 wherein the imaging member is a migration imaging member comprising a conductive substrate layer, a layer of softenable polymeric material, and a fracturable layer of photosensitive particles on or near the surface of the softenable polymeric layer that is not in contact with the conductive layer.

3. A process according to claim 2 wherein the photosensitive particles comprise a material selected from the group consisting of selenium, selenium alloys, and phthalocyanines.

4. A process according to claim 2 wherein the softenable polymeric material is selected from the group consisting of styrene-acrylic copolymers, polystyrenes, styrene-olefin copolymers, styrene-vinyltoluene copolymers, polyesters, polyurethanes, polycarbonates, polyterpenes, silicone elastomers, and mixtures thereof.

5. A process according to claim 2 wherein the conductive layer comprises transparent aluminum, the softenable polymeric layer comprises a styrene-ethylacrylate-acrylic acid copolymer and a dopant selected from the group consisting of N,N'-diphenyl-N,N'-bis(3''-methylphenyl)-(1,1'-biphenyl)-4,4'-diamine and 4-diethylaminobenzaldehyde-1,1-diphenylhydrazone, and the photosensitive particles comprise selenium.

6. A process according to claim 5 wherein the conductive layer has a thickness of from about 75 to about 100 Angstroms, the softenable polymeric layer has a thickness of about 2 microns, and the selenium particles have a diameter of about 0.3 micron.

7. A process according to claim 1 wherein the liquid medium of the liquid developer comprises an aliphatic hydrocarbon.

8. A process according to claim 1 wherein the toner particles comprise pigment particles and a polymeric material adsorbed onto the surfaces of the pigment particles.

9. A process according to claim 8 wherein the pigment particles are selected from the group consisting of carbon black, Sudan Blue OS, Hostaperm Pink E, Permanent Yellow FGL, and Lithol Rubine DCC-2734.

10. A process according to claim 1 wherein the toner particles comprise a polymeric material selected from the group consisting of polyethylene, polypropylene, ethylene-vinyl acetate copolymers, copolymers of ethylene and an $\alpha,\beta$-ethylenically unsaturated acid selected from acrylic or methacrylic acid, chlorinated polyolefins, poly-$\alpha$-olefins, styrene/ethylene-butylene/styrene block copolymers, vinyl toluene acrylic copolymers, polyisobutylene rubbers, and mixtures thereof.

11. A process according to claim 1 wherein the charge control additive is selected from the group consisting of iron naphthenate, zirconium octoate, lecithin, and polyisobutylene succinimide.

12. A process according to claim 1 wherein the liquid developer comprises a paraffinic hydrocarbon liquid medium and toner particles comprising a pigment selected from the group consisting of carbon black, Sudan Blue OS, Hostaperm Pink E, Permanent Yellow FGL, and Lithol Rubine DCC-2734 and a polymeric material selected from the group consisting of polyethylene, polypropylene, ethylene-vinyl acetate copolymers, copolymers of ethylene and an $\alpha,\beta$-ethylenically unsaturated acid selected from acrylic or methacrylic acid, chlorinated polyolefins, poly-$\alpha$-olefins, styrene/ethylene-butylene/styrene block copolymers, vinyl toluene acrylic copolymers, polyisobutylene rubbers, and mixtures thereof adsorbed onto the pigment particles.

13. A process according to claim 1 wherein the liquid developer comprises an isoparaffinic hydrocarbon liquid medium, toner particles comprising carbon black and a vinyltoluene-acrylic copolymer, and a charge control additive.

14. A process according to claim 13 wherein the charge control additive is polyisobutylene succinimide.

15. A process according to claim 1 wherein the liquid developer comprises a liquid medium in an amount of from about 97.5 to about 99.5 percent by weight, toner particles in an amount of from about 0.5 to about 2.5 percent by weight and a charge control additive in an amount of from about 2.5 to about 15 percent by weight of the toner particles and wherein the toner particles comprise a pigment in an amount of from about 25 to about 75 percent by weight, and a polymeric material in an amount of from about 25 to about 75 percent by weight.

16. A process according to claim 1 wherein the developed image exhibits a resolution of at least about 15 line pairs per millimeter.

17. A process according to claim 1 wherein the polymeric coating on the paper is selected from the group consisting of vinyl toluene acrylic copolymers, polybutenes, polyisobutylenes, vinyl halide/vinyl acetate copolymers, and mixtures thereof.

18. A process according to claim 1 wherein the polymeric coating on the paper has a thickness of from about 0.5 to about 10 microns.

19. A process according to claim 1 wherein the image is affixed to the paper by applying pressure in an amount of from about 50 to about 200 pounds per square inch.

20. A process according to claim 1 wherein the image is affixed to the paper at a temperature of from about 80° C. to about 200° C.

21. A process according to claim 1 wherein the liquid developer contains a taggant material selected from the group consisting of fluorescent pigments and infrared sensitive pigments.

22. A process according to claim 21 wherein the taggant material is present in an amount of from about 1 to about 10 percent by weight of the developer.

23. A process for forming secure images which comprises:

(a) electrostatically charging a migration imaging member;

(b) imagewise exposing the charged migration imaging member to form an image on the imaging member;

(c) developing the image with a liquid developer comprising a liquid medium, a charge control additive, and toner particles comprising pigment particles and a polymeric material adsorbed onto the pigment particles;

(d) allowing the developed image to dry on the imaging member;

(e) contacting the portion of the imaging member with the dry developed image with a substantially transparent sheet having an adhesive material on the surface of the substantially transparent sheet in contact with the imaging member, thereby transferring the developed image from the imaging member to the substantially transparent sheet;

(f) contacting the adhesive surface of the substantially transparent sheet with the developed image with a paper sheet having a polymeric coating on at least the surface that is in contact with the substantially transparent sheet; and (g) applying heat and pressure to the substantially transparent sheet and the paper sheet at a temperature and pressure sufficient to affix the image permanently to the paper.

* * * * *